US005833485A

United States Patent [19]

Steinhauser et al.

[11] Patent Number: 5,833,485

[45] Date of Patent: Nov. 10, 1998

[54] MULTI-PLUG ELECTRICAL CONNECTOR

[75] Inventors: Uwe Steinhauser, Filderstadt; Stefan Fenger, Waiblingen, both of Germany

[73] Assignee: Robert Bosch GmbH, Stuttgart, Germany

[21] Appl. No.: 932,800

[22] Filed: Sep. 4, 1997

Related U.S. Application Data

[63] Continuation of Ser. No. 648,233, May 13, 1996.

[30] Foreign Application Priority Data

Jun. 22, 1995 [DE] Germany ..... 295 10 087 U

[51] Int. Cl.[6] ..... H01R 13/627

[52] U.S. Cl. ..... 439/358

[58] Field of Search ..... 439/350–358

[56] References Cited

U.S. PATENT DOCUMENTS

| | | | |
|---|---|---|---|
| 3,933,406 | 1/1976 | Cameron et al. | 439/358 |
| 4,412,714 | 11/1983 | Morningstar et al. | 439/352 |
| 4,900,263 | 2/1990 | Manassero et al. | 439/358 |
| 4,979,910 | 12/1990 | Revil et al. | 439/358 |
| 5,332,330 | 7/1994 | Kaneko | 439/352 |
| 5,520,548 | 5/1996 | Hotea et al. | 439/358 |

*Primary Examiner*—Hien Vu
*Attorney, Agent, or Firm*—Kenyon & Kenyon

[57] ABSTRACT

A multi-plug electrical connector includes an interlocking element. The connector is coupled to a mating connector, such that the interlocking forces of the interlocking element are independent of the unlocking forces of the interlocking element when the connector is released from the mating connector. For this purpose, the interlocking element is actuated to interlock and, to release the interlocking arrangement in directions that differ from one another. Flexural regions and walls, as well as webs of the interlocking element are resiliently deformed. The connector is preferably used in automobile manufacturing under conditions of high stress due to shaking.

3 Claims, 2 Drawing Sheets

MULTI-PLUG ELECTRICAL CONNECTOR

This application is a continuation of application Ser. No. 08/648,233, filed on May 13, 1996.

FIELD OF THE INVENTION

The present invention relates to an electrical connector and more specifically to a multi-plug electrical connector.

BACKGROUND INFORMATION

German Patent Application No. 37 31 996 A1 describes providing an interlocking element for a connector of the afore-mentioned type, when the connector is coupled to a mating connector, the interlocking element mechanically securing the thus formed plug-in connection and releasing it again to disengage the plug-in connection.

The interlocking element is comprised of a bending bar that sticks out at an acute angle from a contact carrier as a housing part of the connector, and is connected at its one end, as a bearing point, to the contact carrier, and is resiliently retractable transversely to the plug-in direction of the connector. Mounted on the interlocking element is a projection, which rises in a ramp shape in the plug-in direction and terminates with a detent surface running transversely to the plug-in direction.

When the plug-in connection is closed, this projection grips with resilient deflection of the interlocking element, transversely to the plug-in direction, into a cut-out of the mating connector and locks in there. To release the plug-in connection, the unattached end of the interlocking element is pressed transversely to the plug-in direction, so that the projection can come out of the mating connector and so that the interlocking is released.

Thus, when closing and releasing the plug-in connection, the interlocking element is actuated in the same direction and the resiliency forces that thereby occur, whose magnitude is dependent upon the form of the connecting of the interlocking element to the contact carrier, are equal during closing and releasing, assuming the same deflections When working with plug-in connections, which are supposed to meet substantial mechanical-stress requirements, such as stringent shakeproof requirements, it is expedient to reinforce the retention forces of the interlocking element, given a closed plug-in connection, with respect to the handling forces the interlocking element is subjected to when the plug-in connection is released, in order to obtain an especially stable plug-in connection which can be easily released in case of need.

As described, however, it is not possible to realize this with the previously-described interlocking element.

SUMMARY OF THE INVENTION

In contrast, the multi-pole electrical connector according to the present invention has the advantage that the previously mentioned shortcomings are avoided to a satisfactory extent. For this purpose, the connector has an interlocking element corresponding to a releasing of the plug-in connection, which for the interlocking operation, corresponding to closing the plug-in connection, is actuated in another direction than when releasing the interlocking connection.

It is, thus, possible for the deformation regions of the interlocking element to be designed differently for the two actuation directions and, by this means, for the retention forces of the interlocking element to be reinforced, given a closed plug-in connection, with respect to the handling forces of the interlocking element when releasing the plug-in connection.

DETAILED DESCRIPTION

Figure 1:
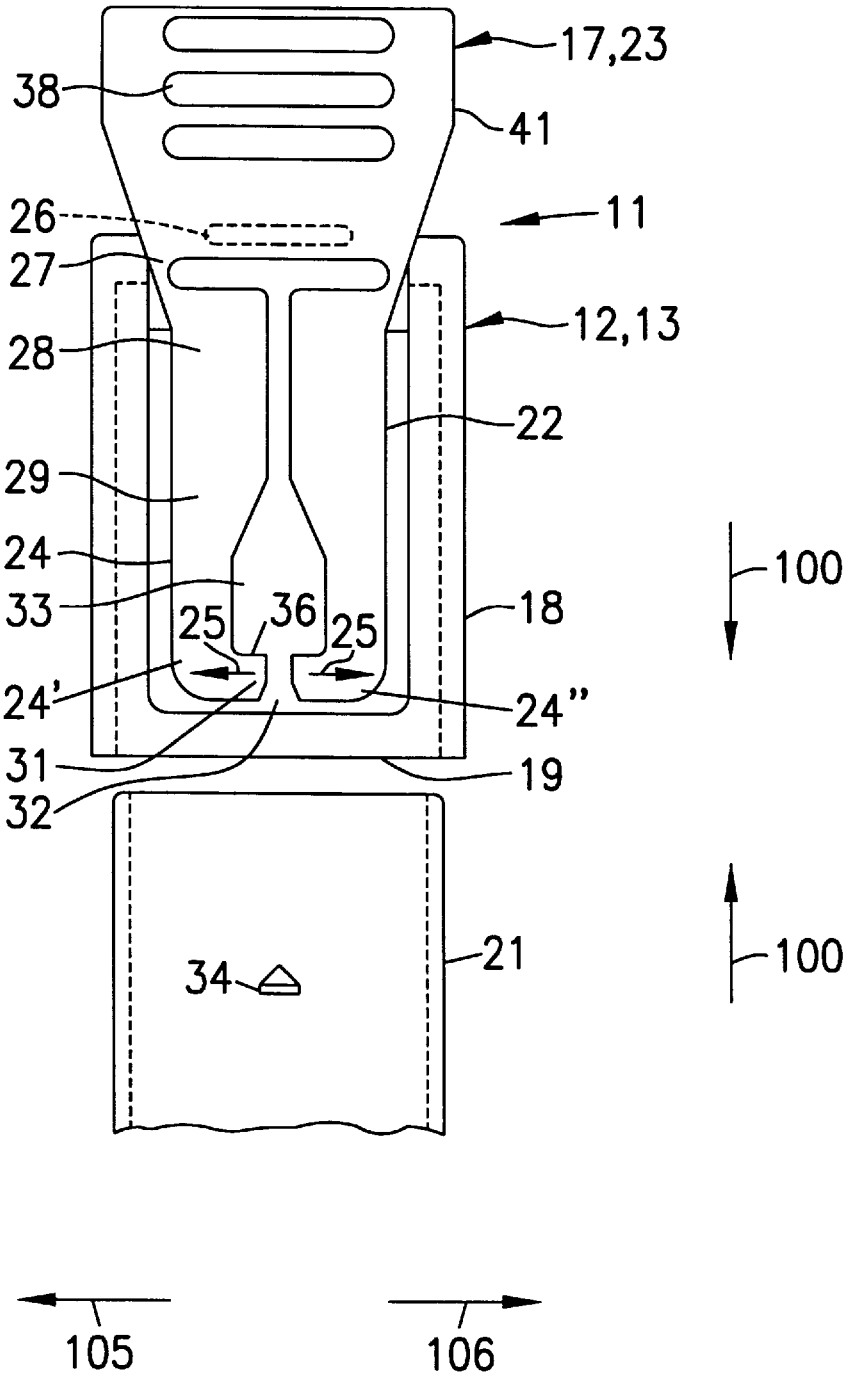
FIG. 1 schematically shows a connector with an interlocking element and a mating connector with a counter-interlocking element according to the present invention, given an open plug-in connection.
Figure 2:
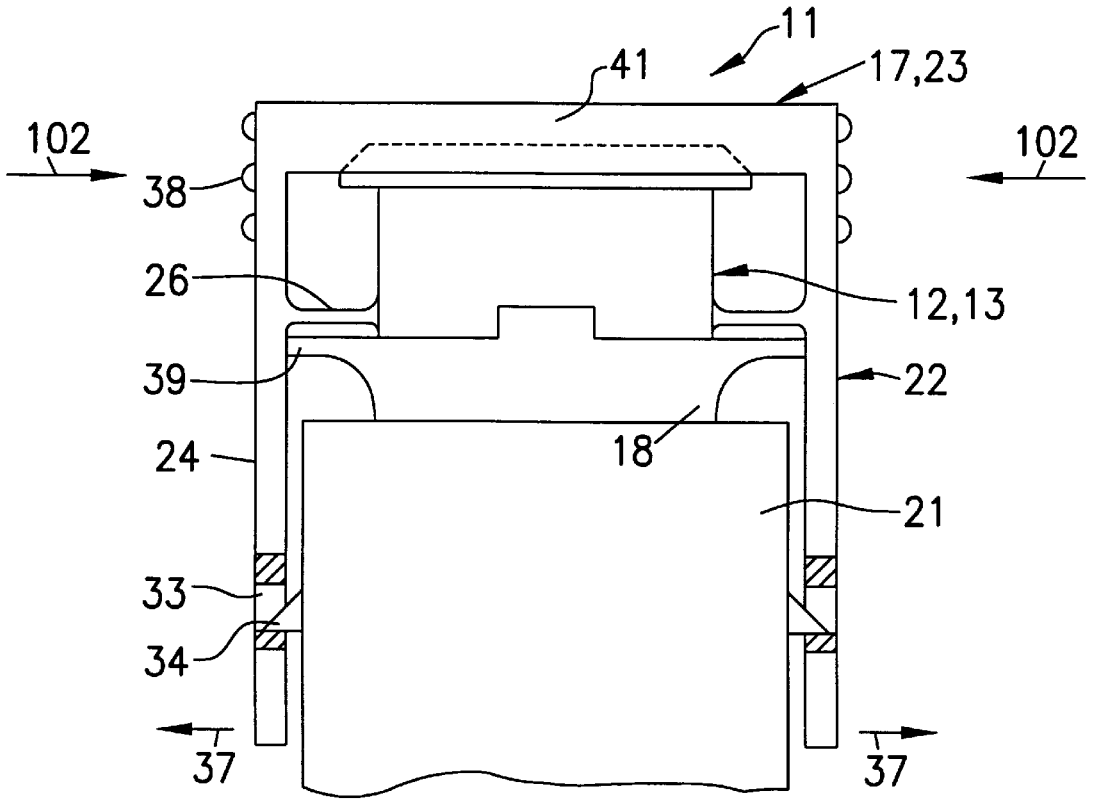
FIG. 2 illustrates the connector with the interlocking element and the mating connector with the counter-interlocking element according to the present invention, given a closed plug-in connection, in a side view rotated by 90° from FIG. 1.
Figure 3:
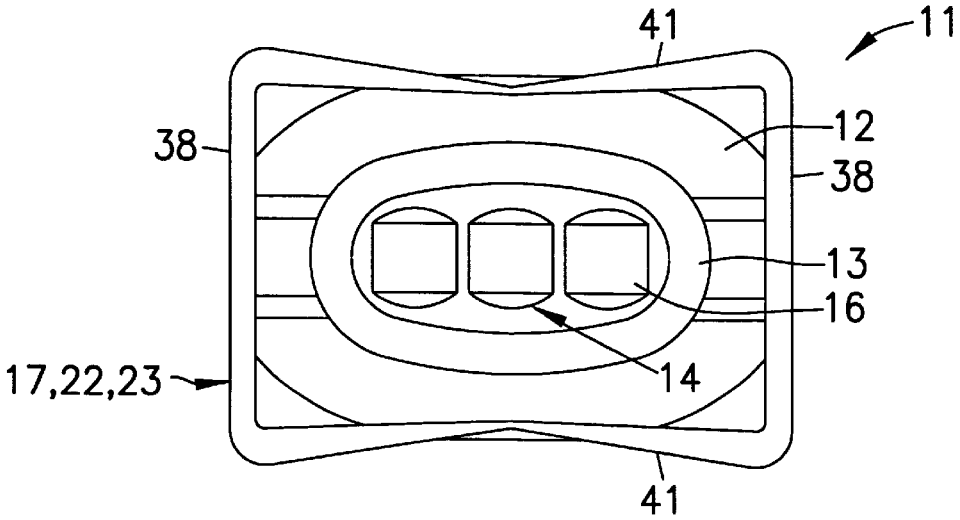
FIG. 3 shows the connector according to the present invention in a plan view.

A multi-pole electrical connector 11 according to FIGS. 1–3 has, made of plastic, a housing 12 and, as a housing part, a contact carrier 13. The contact carrier 13 comprises a row 14 of chambers with three receiving chambers 16 (FIG. 3), into which contact elements (no longer shown) are inserted. The housing 12 has a line terminal part 17 and an oppositely-directed sleeve-shaped insertion part 18 with a receiving orifice 19 at the extremity for accommodating a mating connector 21 to form a plug-in connection.

A one-piece interlocking element 22 is premolded on the housing 12 in the vicinity of the line terminal part 17.

As its main components, the interlocking element 22 comprises a frame 23, which is basically rectangular in shape, four limbs 24 arranged in pairs and projecting from the frame 23, and two webs 26 at the transition between the frame 23 and the limbs 24, each one being assigned one pair of limbs 24 and the webs binding the interlocking element 22 to the housing 12.

At their extremities, at the transition to the frame 23, each of the limbs 24 has a flexural region 27, which is so tapered with respect to the other parts of the limbs 24 that a resilient outwards bending of the limbs 24 in the direction of the arrows 25 is possible. Viewed in cross-section, contiguous to each of the flexural region 27 is a rectangular upper section 28, and joined to that a narrower lower section 29 of the same shape and a hook-shaped end section 31.

Every two limbs 24 oppose one another so as to form a more or less funnel-shaped entrance opening 32 between the end sections 31 aligned towards one another, said entrance opening 32 turning into an elongated cut-out 33, which is wider between the bottom sections 29 than between the upper sections 28.

To close the plug-in connection, as can be explained, in particular, on the basis of FIG. 1, the connector 11 and the mating connector 21 are brought together in the plug-in direction 100, the mating connector 21 being able to plunge into the receiving orifice 19 and into the insertion region 18 of the connector 11. In so doing, a wedge-shaped counter-interlocking element 34 (FIGS. 1, 2) of the mating connector 21 attains the entrance opening 32 and passes the same while spreading apart the limbs 24 in the direction of the arrows 25, second direction, which give way in the flexural regions 27. After that, the limbs 24 spring back, and the counter-interlocking element 34 is locked into the cut-out 33.

When the mating connector 21 or the connector 11 moves opposite the plug-in direction, a front-side detent surface 36 behind the entrance opening 32 forms the catch blocking removal of the counter-interlocking element 34. The plug-in connection is, thus, mechanically interlocked in the closed state.

To release the plug-in connection, as can be explained on the basis of FIG. 2, the limbs 24, which are placed in pairs on mutually opposing sides of the housing 12, are brought out of the engagement area of the counter-interlocking element 34 by swinging out resiliently in the second direction of the arrows 37 and transversely to the spreading action in the case of the interlocking element i.e., a first limb 24' swings in a fourth direction 105, and a second limb 24" swings in a fifth direction 106).

For this purpose, one grip-type strip 38 is mounted on the frame 23, which surrounds the line terminal part 17 with clearance, on each of the mutually opposing sides and in alignment with the limbs 24. By pressing on the grip-type strips 38 opposite the direction of the arrows 37 (third direction 102), the limbs 24, which are each braced against a rounded strip 39 underneath the webs 26, are swung out about the strip in the direction of the arrows 37. This swinging-out action takes place resiliently, since the two sides of the frame 23 bearing the grip-type strips 38 are joined by two mutually opposing walls 41 (FIG. 3), which, curved toward one another, have predetermined deformation directions transversely to the plug-in direction and are prestressed in the manner of an arc into these deformation directions by applying pressure to the grip-type strips 38.

This swinging of the limbs 24 out of the engagement area of the counter-interlocking element 34 and the releasing of the connector 11, along with the retracting of the connector 11 from the mating connector 21, are rendered possible by the flexible suspension of the interlocking element 22 on the housing 12 by means of the webs 26.

With a so-designed connector 11, comprising a premolded, one-piece interlocking element 22, the retention forces of the interlocking element 22, given a closed plug-in connection, are able to be adapted to the operating conditions of the connector 11, e.g., high stresses due to shaking, by appropriately dimensioning the flexural regions 27, on the one hand, and by forming the walls 41 and the webs 26, on the other hand, without affecting the handling forces of the interlocking element 22, which are conceived with the aim in mind of an easily released plug-in connection.

By designing the handling part of the interlocking element 22 as a closed frame 23, which is situated on the line terminal part 17 of the interlocking element 22, one effectively prevents squeezing lines from adversely affecting the functioning of the interlocking element 22, thus enhancing the manufacturing reliability for the connector.

What is claimed is:

1. A multi-plug electrical connector for coupling to a mating connector, comprising:

a contact carrier made of insulating material having at least one row of chambers for accommodating contact elements;

a one-piece interlocking element including at least one pair of mutually opposing limbs, the at least one pair of mutually opposing limbs including a cut-out section therebetween, the cut-out section ending in an entrance opening with detent surfaces of the cut-out section that widen after the entrance opening, and the at least one pair of mutually opposing limbs interlocking with a counter-interlocking element of the mating connector by deflecting outwardly within a plane and releasing from the counter-interlocking element by deflecting in a direction perpendicular to the plane; and a closed frame integrally formed with the interlocking element and coupled to the contact carrier, the frame including a pair of side walls on opposite sides of the contact carrier, one of the pair of side walls being in alignment with the at least one pair of mutually opposing limbs, and the frame including a pair of V-shaped deformable walls connecting the pair of side walls wherein an application of inward pressure to the pair of side walls causes the interlocking element to pivot about a rounded strip connected to the contact carrier so that the at least one pair of mutually opposing limbs deflects from an initial position in the direction perpendicular to the plane and wherein a release of inward pressure to the pair of side walls allows the deformable walls to bias the pair of side walls outwardly to an unbiased position, thereby returning the at least one pair of mutually opposing limbs to the initial position.

2. A multi-plug electrical connector for coupling to a mating connector, comprising:

a contact carrier made of insulating material having at least one row of chambers for accommodating contact elements;

a one-piece interlocking element interlocking with a counter-interlocking element of the mating connector, the interlocking element including at least one pair of mutually opposing limbs having a cut-out section therebetween, the cut-out section ending in an entrance opening with detent surfaces of the cut-out section that widen after the entrance opening, flexural regions deforming when the interlocking element slides onto the counter-interlocking element, such that the at least one pair of mutually opposing limbs deflect outwardly within a plane and lock in resiliently behind the counter-interlocking element; and a frame including a pair of webs, the frame coupled to the interlocking element and coupled to the contact carrier via the pair of webs, the frame including a pair of side walls on opposite sides of the contact carrier, one of the pair of side walls being in alignment with the at least one pair of mutually opposing limbs, and the frame including a pair of deformable walls connecting the pair of side walls, such that the pair of webs couple the interlocking element to a housing and are resiliently deformable for moving the mutually opposing limbs, wherein the frame is a closed frame having a first flexible region with a first predetermined deformation direction perpendicular to the at least one row of chambers and a second flexible region with a second predetermined deformation direction perpendicular to the at least one row of chambers and opposite that of the first flexible region, and the at least one pair of mutually opposing limbs are located at mutually opposing sides of the interlocking element whereby each of the mutually opposing limbs is coupled to the closed frame, and wherein an application of inward pressure to the pair of side walls causes the pair of deformable walls to deform and causes the interlocking element to pivot about a rounded strip connected to the contact carrier so that the at least one pair of mutually opposing limbs deflect from an initial position in a direction perpendicular to the plane, thereby allowing the interlocking element to be disengaged from the counter-interlocking element.

3. The multi-plug electrical connector according to claim 2, wherein each of the pair of deformable walls is V-shaped; and wherein a release of inward pressure to the pair of side walls allows the pair of deformable walls to bias the pair of side walls outwardly to an unbiased position, thereby returning the at least one pair of mutually opposing limbs to the initial position.

* * * * *